United States Patent [19]

Ernest

[11] Patent Number: 4,766,747

[45] Date of Patent: Aug. 30, 1988

[54] VEHICLE DOOR LOCKING SYSTEM

[75] Inventor: Norman A. Ernest, Solihull, England

[73] Assignee: Rockwell Automotive Body Components (U.K.) Limited, Birmingham, England

[21] Appl. No.: 14,762

[22] PCT Filed: Jun. 10, 1986

[86] PCT No.: PCT/GB86/00332

§ 371 Date: Mar. 5, 1987

§ 102(e) Date: Mar. 5, 1987

[87] PCT Pub. No.: WO86/07405

PCT Pub. Date: Dec. 18, 1986

[30] Foreign Application Priority Data

Jun. 13, 1985 [GB] United Kingdom ..... 8515039

[51] Int. Cl.[4] ..... E05B 53/00

[52] U.S. Cl. ..... 70/264; 70/277

[58] Field of Search ..... 70/264, 263, 277; 292/201, 144, 216; 74/57

[56] References Cited

U.S. PATENT DOCUMENTS 4,290,634 9/1981 Gelhard ..... 292/201

4,518,181 5/1985 Yamada ..... 292/201

*Primary Examiner*—Robert L. Wolfe

*Attorney, Agent, or Firm*—Charles O. Marshall, Jr.

[57] ABSTRACT

Central locking system for vehicle doors includes an electric actuator (13) whose motor (21) drives a snail cam (23) for shifting a lock operating lever (25) between locked and unlocked positions. The lever is held at the respective position with the cam at the extremes of its travel but is free to be operated manually e.g. by a sill button of the associated door, when the cam is at mid travel. A spring (35) is arranged to urge the cam in one direction only from the unlocked extreme to mid travel but does not affect the cam at the locked extreme enabling the door to be dead-locked using the actuator i.e. so that it remains locked until the actuator is operated to shift the cam away from that extreme.

9 Claims, 2 Drawing Sheets

VEHICLE DOOR LOCKING SYSTEM

This invention relates to locking systems for vehicle doors of the kind in which a central control unit is connected to the individual locks for electrical actuation of the latter whereby locking or unlocking of all the doors can be effected from a single control station actuated from within or outside the vehicle, e.g. by the use of a key and/or some kind of remote control such as a radio or infra-red emitter and systems of this kind are hereinafter referred to as "central locking systems".

A disadvantage of many known types of vehicle lock including those actuated by or forming part of a central locking system is that there is no dead-locking facility, i.e. there is nothing positively retaining the lock mechanism at the secure position and it can be freed quite readily for example by operating manual actuating means on the inside of the door such as the internal door handle or sill release button. This may be done by forcing a window and operating the button or the like using wire or some similar tool to unlock the door and gain unauthorised access to the vehicle interior.

Central locking systems with a dead-locking feature have been proposed but these have hitherto involved special forms of lock mechanism and lock actuators which are complex and costly to provide and which have therefore hitherto only been available on more expensive types of vehicle.

The object of the present invention is to provide a simple and economical central locking system having a low cost and effective dead-locking facility which is easy to operate, reliable in use, and makes use of a known type and size of actuator so that it can readily be provided as a modification of existing central locking systems without any substantial redesign or increase in tooling costs.

According to a first aspect of the invention there is provided a power actuated unit for a central locking system including a lock actuating formation shiftable between locked and unlocked positions; a motor driven rotary cam having a snail formation co-acting with said actuating formation for selective movement thereof in response to operation of a central control unit of the system in use, said snail formation being shaped to prevent displacement of the actuating formation from the locked position at a first angular position of the cam whereby the lock is held in a dead-locked condition but to permit unrestricted movement of the lock actuating formation between the locked and unlockd positions at a second angular position of the cam remote from the first position, and to positively displace the actuating formation to the unlocked position at a third angular position of the cam remote from the second position and on the opposite side thereof to the first position; and resilient means urging the cam in one direction of rotation only away from the third position towards the second angular position whereby once driven to the first angular position the cam will remain at that position to retain the actuating formation in the dead-locked condition until movement to the second or third angular position is effected by a further operation of the central control unit.

The invention further resides in a central locking system including one or more power actuated units as defined by the last preceding paragraph and a central control unit.

Preferably said last mentioned central locking system includes a subsidiary or overriding control circuit whereby the motor or motors of the actuating unit or units or a preselected proportion thereof can be operated at reduced power in response to a signal to the central control unit derived from actuation of manual internal release means, e.g. a sill button or handle on the interior of one or more of the vehicle doors, said power being sufficient to displace the cams of the actuating units to the second position while not overcoming the force of the resilient means resisting movement beyond that position whereby the associated door or doors can then be selectively unlocked by the use of said internal means, e.g. for emergency escape from the vehicle.

An example of the invention is now described in greater detail with reference to the accompanying drawings wherein.

Figure 1:
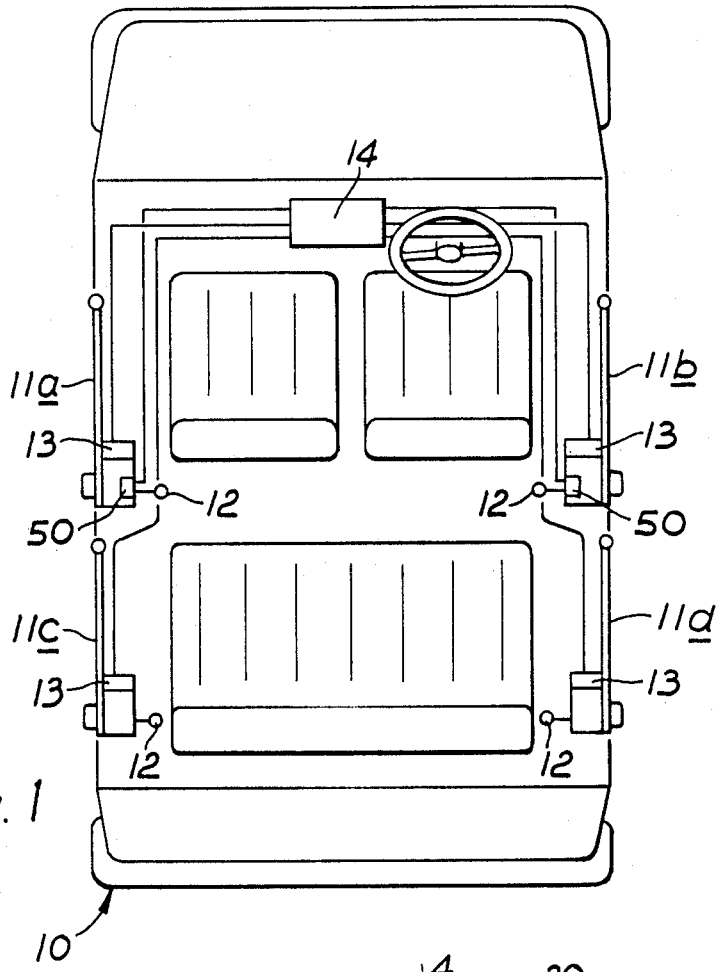
FIG. 1 is a diagram of a vehicle fitted with a central locking system.

Referring to FIG. 1 a vehicle body shown diagrammatically at 10 has, in this example, four doors, two front doors 11*a*, 11*b* and two rear doors 11*c* and 11*d*, each having a respective lock mechanism of known kind including manually operable internal release means which, in this example, consists of a respective sill button 12 of known kind. Power actuating units 13 to be described in further detail below are mounted in association with each locking mechanism on each door and are electrically connected to a central control unit 14 of the locking system. Further locking mechanisms, e.g. of a tail-gate or boot lid and/or bonnet may also be provided with power actuated units interconnected with the cental control unit 14 but these have not been shown for clarity.

Figure 2:
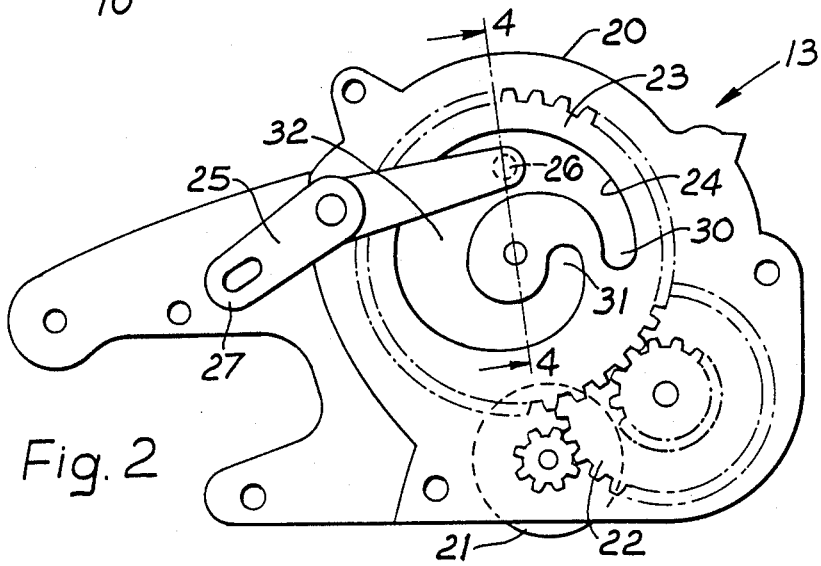
FIG. 2 is an end view of an actuating unit of the system with an end plate removed.
Figure 3:
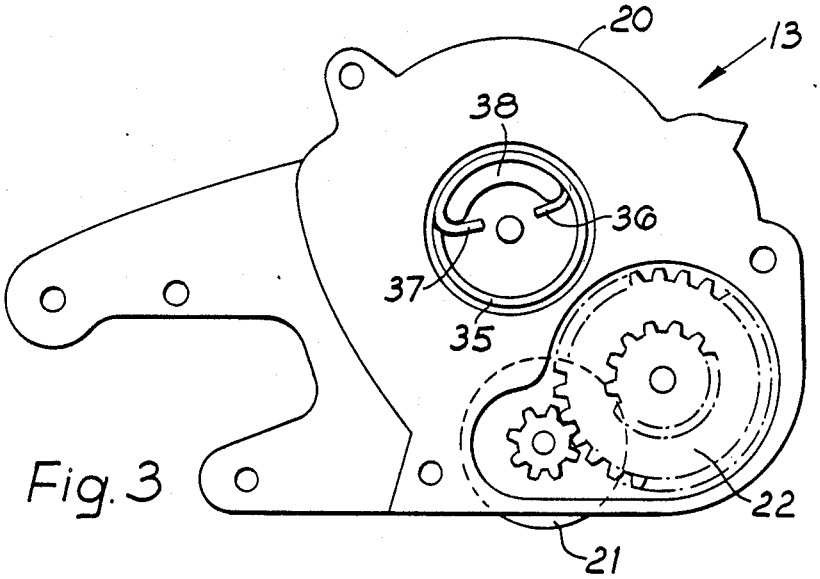
FIG. 3 is a like view to FIG. 2 but with a cam removed.
Figure 4:
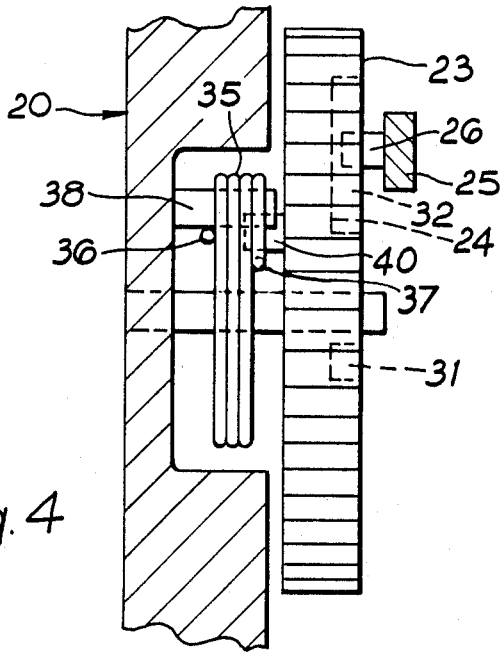
FIG. 4 is a sectional view on line 4—4 of FIG. 2.

Referring to FIGS. 2–4 one of the actuating units 13 will now be described in greater detail. A body 20 of the unit to be operatively mounted in a convenient fixed location on or in the respective door 11 mounts an actuating motor 21 and encloses a gear train 22 which drivingly connects the motor to a rotary cam 23, conveniently a plastics moulding, one face of which is formed to provide a snail formation in the form of a spiral profile hollow.

A lock actuating formation in the form of a bell crank 25 pivoted on body 20 has an end formation in the form of a pin 26 which co-acts with snail formation 24, the opposite end 27 of crank 25 projecting from body 20 and being operatively connected to the door lock mechanism (not shown), cam 23 serving to shift lever 25 angularly between locked and unlocked positions for corresponding mechanical operation of the locking mechanism.

The profiling of snail formation 24 is such that it extends through substantially 360° in this example from a radially outer end 30 which is narrow enough to confine the pin 26 of lever 25 against angular movement so retaining it positively at the locked position, and a radially inner end 31 of like width which will constrain pin 26 for positive location of lever 25 at the unlocked position.

Formation 24 increases in radial width away from ends 30, 31 to a maximum width portion indicated generally at 32 which, when in co-acting relationship with pin 26 permit unobstructed angular movement of lever 25 between the unlocked and locked positions.

A cylindrically coiled torsion spring 35 having radially inwardly directed first and second hooked ends 36, 37 locates in a hollow of body 20 co-axially with cam 23 and behind the cam as viewed from the snail formation side. Both hooked ends locate against the opposite ends of a crescent-shaped boss 38 within said hollow, first end 36 being spaced axially further away from the rear face of cam 23 than second end 37 in the assembled condition.

The rear face of cam 23 is provided with an axially projecting abutment 40 which, as the cam rotates in one direction, engages the nearer second end 37 of spring 35 though it is not long enough to engage the first end 36 when rotating in the opposite direction.

Spring 35 is so disposed that when cam 23 is rotated to a first angular position at which the radially outer end 30 of snail formation 24 engages pin 26 the spring is not engaged, thus when motor 21 drives cam 23 to this position it will remain there and not be displaced (the ratio of gear train 22 is sufficient to resist any accidental displacement due to vibration etc) until motor 21 is operated in the reverse direction to shift the cam away from the position. Thus, in this position, the associated locking mechanism is dead-locked i.e. it cannot be displaced or released by mechanical actuation of the associated sill button 13, door handle or the like.

When cam 23 is shifted to a second angular position at which maximum width portion 32 of formation 24 is in co-acting relationship with pin 26, lever 25 can move freely and the locking mechanism can be actuated using sill button 13 or the exterior door handle, i.e. the door can be fastened or unfastened manually in the usual way.

When motor 21 is operated to drive cam 23 to a third angular position at which the radially inner end 31 of formation 24 co-acts with pin 26 lever 25 is positively displaced to the unlocked position to free the door mechanism, i.e. all the doors can be locked or unlocked from the central control unit by operation of the motors 21 of the respective actuating unit 13 simultaneously. In moving cam 23 from the second to the third position boss 38 engages the second end 37 of spring 35 so that it is tensioned. Once the operating pulse of current to motor 21 has been terminated, i.e. unlocking has been effected, spring 35 urges cam 23 back to the second or mid-position referred to above.

With the arrangement as so far described it will be appreciated that it would be possible to lock all the vehicle doors from the central control unit 14 while the vehicle is occupied (which may be desirable in some circumstances from the point of view of security of the occupants) but, as all the doors will then be dead-locked, this would have the disadvantage that the occupants could not readily release themselves from the vehicle, e.g. a passenger could not undo his door in an emergency without calling on the driver to operate the central control unit. To avoid this an overriding provision is made.

All or selected ones of the sill buttons 12 (e.g. those of the front doors 11*a*, 11*b*) may be provided with overriding switches indicated diagrammatically on FIG. 1 at 50 connected into a subsidiary operating circuit including control unit 14. Operation of sill button 12 will acutate the associated switch 50 causing the central control unit to pass a current at a reduced voltage to the motors 21 of the actuating units 13 to drive them in a direction for moving the associated cams 23 from the first to the second positions, so freeing the associated levers 25 for free movement between the locked and unlocked positions, thus the associated door or doors can be released, e.g. by the passengers using the sill buttons 12 in the normal way. The reduced current applied to each motor 21 is sufficient to displace cam 23 between the first and second positions (during which travel spring 35 is not engaged) but is not sufficient to overcome the force of said spring and drive the cam 23 to the third position at which the doors are positively unlocked. Thus only those doors which are mechanically unlocked e.g. by use of the sill buttons 12 are released.

It is to be understood that for some applications the operation of cam 23 may be reversed, i.e. the radially inner end 31 of the snail formation 24 may be utilised to retain the lever 25 at the locked position and the outer end 30 may be utilised to shift it positively to the unlocked position, in this case the disposition and action of spring 35 would be reversed to give the overriding feature referred to above and the polarity of the current applied to motor 21 would also be reversed for drive in the opposite direction.

I claim:

1. A power actuated unit for use in combination with lock mechanism for operation by a central locking system, said unit including (a) a lock actuating formation shiftable between a locked position at which the lock mechanism is held secure and an unlocked position at whcih said mechanism is freely releasable;

(b) a rotary cam having a snail formation coacting with said actuating formation, said snail formation being so profiled that the actuating formation is positively driven to the locked position, and is positively retained against movement from that position when the cam is at a first angular position, so that the lock mechanism is thereby dead-locked in the secure condition while the cam remains at said first position, that the actuating formation is freed for movement between the locked and unlocked positions without restriction by the snail formation when the cam is at a second angular position remote from the first position, and that the actuating formation is positively driven to the unlocked position when the cam is at a third angular position and on the side thereof opposite to the first position;

(c) motor drive means responsive to operation of an electrical central control unit of the locking system for selective angular displacement of the rotary cam in either direction; and (d) resilient means acting unidirectionally on the cam between the third and second positions only, to provide a restoring force urging the cam to return to the second position from the third position but not exerting any force on the cam between the second and first positions whereby once driven to the first position the can will remain thereat to hold the mechanism deadlocked until movement from that position is effected by operation of the central control unit, whereby the cam will be automatically restored to the second position freeing the lock mechanism for unrestricted operation thereof following powered displacement to the third position, and whereby greater power is needed to shift the cam from the second position to the third position against the force of the reslient means than is needed to shift the cam between the first and second positions.

2. A unit as in claim 1 characterised in that the snail formation (24) is a hollow of spiral profile in a face of the rotary cam.

3. A unit as in claim 2 characterised in that said hollow has an angular extent about the cam axis of substantially 360°.

4. A unit as in claim 2 characterised in that the lock actuating formation (25) is a lever one arm of which carries a pin (26) in coacting relationship with said hollow.

5. A unit as in claim 4 characterised in that the radially outer and radially inner ends (30,31) of said hollow are dimensioned to constrain the pin (26) of said lever arm against angular movement, a median portion (32) of said hollow being wide enough to permit angular movement of said arm between locked and unlocked positions.

6. A unit as in claim 1 characterised in that the resilient means is coiled torsion spring (35) both ends (36,37) of which engage an anchorage formation (38) of the body with the spring in an undeformed condition, an axially extending abutment (40) of the cam (23) being engageably with one said spring end (37) only whereby the spring is tensioned as the cam is moved from the second to the third position but is not so engaged when the cam is moved between the second and the first position.

7. A central locking system for a vehicle including a plurality of power actuated units (13) each as defined in claim 1, and a central control unit (14) characterised by a subsidiary control circuitwhereby at least a preselected proportion of the motors (21) of the actuating units can be operated at reduced power in response to a signal to the central control unit derived from actuation of manual internal release means (12), said reduced power being sufficient to displace the cams (23) of the associated actuating units to the second position but not being sufficient to overcome the force of the resilient means (35) to move said cams beyond that position, so allowing the locks of the associated door or doors (11) to be selectively freed for manual unlocking by the use of their internal release means.

8. A system as in claim 7 characterised in that the internal release means is an interior manual lock actuator (12) of one or more of the vehicle passenger doors (11).

9. A system as in claim 7 characterised in that the signal for causing said reduced power operation is derived from actuation of the internal release means (12) of either of the front passenger doors (11*a*, 11*b*) of the vehicle only.

* * * * *